US008419384B2

(12) United States Patent
Jang et al.

(10) Patent No.: US 8,419,384 B2
(45) Date of Patent: Apr. 16, 2013

(54) SLIDING VANE PUMP

(75) Inventors: Jie Jang, Nashville, TN (US); Robert R. Kimberlin, Murfreesboro, TN (US)

(73) Assignee: Standex International Corporation, Salem, NH (US)

( * ) Notice: Subject to any disclaimer, the term of this patent is extended or adjusted under 35 U.S.C. 154(b) by 850 days.

(21) Appl. No.: 12/250,753

(22) Filed: Oct. 14, 2008

(65) Prior Publication Data

US 2009/0104049 A1 Apr. 23, 2009

Related U.S. Application Data

(60) Provisional application No. 60/980,932, filed on Oct. 18, 2007.

(51) Int. Cl.
*F04B 49/00* (2006.01)

(52) U.S. Cl.
USPC ..... 417/309; 417/261; 417/310; 417/311

(58) Field of Classification Search ..... 417/261, 417/309–311
See application file for complete search history.

(56) References Cited

U.S. PATENT DOCUMENTS

| | | | | |
|---|---|---|---|---|
| 2,739,539 | A * | 3/1956 | Gardiner | 418/133 |
| 3,097,610 | A | 7/1963 | Swanson | |
| 3,574,493 | A * | 4/1971 | Hamilton | 418/268 |
| 3,834,846 | A * | 9/1974 | Linder et al. | 418/270 |
| 4,543,228 | A | 9/1985 | Bingler | |

(Continued)

FOREIGN PATENT DOCUMENTS

| | | |
|---|---|---|
| DE | 2622164 A1 | 12/1977 |
| DE | 3324878 | 1/1984 |

(Continued)

OTHER PUBLICATIONS

Machine Translation of DE 2622164A1 obtained from European Patent Office database.

*Primary Examiner* — Nimeshkumar Patel
*Assistant Examiner* — Thomas A Hollweg
(74) *Attorney, Agent, or Firm* — Luedeka Neely Group, P.C.

(57) ABSTRACT

The present disclosure provides a fluid pump having a pump motor, a pump drive shaft, and a vane pump assembly. The vane pump assembly includes a pump housing with a fluid inlet port in a distal portion of the housing and a fluid outlet port in a proximate portion. A first bearing member, having a plurality of inlet orifices in flow communication with the fluid inlet port, is disposed within the housing distal portion. A cam ring is adjacent the first bearing member. A rotor, which is mounted on the pump drive shaft, is disposed within an opening in the cam ring. This rotor includes a plurality of radial slots and vanes slidably received within the slots. A second bearing member, having a plurality of outlet orifices in flow communication with the fluid outlet port, is disposed within the housing proximate portion adjacent the cam ring. An end plate is also mounted within the distal portion of the pump housing. Rotation of the rotor by the drive shaft causes fluids from the fluid inlet port to be drawn through the plurality of inlet orifices at an initial fluid pressure. The fluids are then directed along a plurality of fluid flow paths disposed between an inner surface of the cam ring and an outer surface of the rotor, and then ejected through the plurality of outlet orifices to the fluid outlet port at a second fluid pressure which is greater than the initial fluid pressure.

23 Claims, 5 Drawing Sheets

U.S. PATENT DOCUMENTS

| | | | | |
|---|---|---|---|---|
| 4,716,726 | A | 1/1988 | Nowaczyk | |
| 5,462,413 | A | 10/1995 | Schroeder | |
| 5,642,991 | A | 7/1997 | Singleterry et al. | |
| 5,842,600 | A | 12/1998 | Singleterry et al. | |
| 5,919,033 | A | 7/1999 | Singleterry et al. | |
| 6,050,796 | A | 4/2000 | Wong et al. | |
| 6,088,916 | A | 7/2000 | Singleterry et al. | |
| 6,149,409 | A | 11/2000 | Palakodati et al. | |
| 6,153,690 | A | 11/2000 | Larson et al. | |
| 6,394,776 | B2 * | 5/2002 | Boldenow | 418/69 |
| 6,481,992 | B2 | 11/2002 | Wong et al. | |
| 6,503,064 | B1 | 1/2003 | Croke et al. | |
| 6,629,829 | B1 | 10/2003 | Shinoda | |
| 6,790,019 | B1 | 9/2004 | Hinchey, Jr. | |
| 6,814,549 | B2 | 11/2004 | Kimberlin et al. | |
| 6,837,688 | B2 | 1/2005 | Kimberlin et al. | |
| 6,847,140 | B2 | 1/2005 | Kimberlin et al. | |
| 6,861,777 | B2 | 3/2005 | Kimberlin et al. | |
| 6,863,504 | B2 | 3/2005 | Kimberlin et al. | |
| 6,884,043 | B2 | 4/2005 | Kimberlin et al. | |
| 7,709,988 | B2 * | 5/2010 | Kaminski et al. | 310/156.29 |
| 2002/0122735 | A1 | 9/2002 | Bishop et al. | |
| 2003/0161743 | A1 * | 8/2003 | Kimberlin et al. | 417/410.3 |

FOREIGN PATENT DOCUMENTS

| | | | |
|---|---|---|---|
| EP | 0384335 | A1 | 2/1990 |
| EP | 1176311 | A2 | 1/2002 |
| GB | 1140213 | | 1/1969 |
| WO | WO03083311 | A2 | 10/2003 |
| WO | 2007062116 | | 5/2007 |

* cited by examiner

SLIDING VANE PUMP

CROSS REFERENCE TO RELATED APPLICATIONS

This application claims the benefit of the filing date of copending provisional application No. 60/980,932 filed Oct. 18, 2007.

FIELD

The present disclosure relates to fluid pumps, and more particularly relates to an improved sliding vane pump.

BACKGROUND

Sliding vane pumps are known and are well suited to a variety of pumping application due to their reliability and relatively few moving parts. Typically, however, the components of sliding vane pumps must be manufactured from metals such as stainless steel which are very strong and hence expensive. Moreover, significant forces are exerted upon the moving components which typically require that these components be manufactured to very exacting tolerances. These high tolerances also increase manufacturing costs. A need therefore exists for an improved sliding vane pump which may utilize less expensive materials of construction, such as plastics, and which may be fibricated to less exacting physical tolerances.

SUMMARY

In a first aspect, the present disclosure provides a vane pump assembly for a fluid pump. According to one embodiment, the vane pump assembly includes a pump housing having a proximate portion and a distal portion. The proximate portion of the housing is adapted to be mounted to a pump motor. A fluid inlet port is formed in a distal portion of the housing and a fluid outlet port is formed in a proximate portion of the housing.

The vane pump assembly also includes a first bearing member which is disposed within the distal portion of the housing and which also has a plurality of inlet orifices in fluid flow communication with the fluid inlet port. A cam ring is also disposed within the housing adjacent the first bearing member. A rotor, which is adapted to be mounted to a pump drive shaft, is disposed within an opening in the cam ring. This rotor includes a plurality of radial slots formed therein and a plurality of vanes slidably received within the slots of the rotor. The vane pump assembly also includes a second bearing member which is disposed within the proximate portion of the housing adjacent the cam ring and which also has a plurality of outlet orifices in fluid flow communication with the fluid outlet port. An end plate is also mounted within the distal portion of the pump housing.

Rotation of the rotor by the pump drive shaft causes fluids from the fluid inlet port to be drawn through the plurality of inlet orifices at an initial fluid pressure. The fluids are then directed along a plurality of fluid flow paths disposed between an inner surface of the cam ring and an outer surface of the rotor, and then ejected through the plurality of outlet orifices to the fluid outlet port at a second fluid pressure which is greater than the initial fluid pressure.

In a second aspect, the present disclosure provides a fluid pump. According to one embodiment, the fluid pump includes a pump motor, a pump drive shaft attached to the pump motor, and a vane pump assembly.

The vane pump assembly, in turn, includes a pump housing having a proximate portion and a distal portion. The proximate portion of the housing is mounted to a pump motor so that the pump drive shaft extends through the proximate portion of the pump housing. A fluid inlet port is formed in a distal portion of the housing and a fluid outlet port is formed in a proximate portion of the housing.

The vane pump assembly also includes a first bearing member which is disposed within the distal portion of the housing and which also has a plurality of inlet orifices in fluid flow communication with the fluid inlet port. A cam ring is also disposed within the housing adjacent the first bearing member. A rotor, which is mounted on the pump drive shaft, is disposed within an opening in the cam ring. This rotor includes a plurality of radial slots formed therein and a plurality of vanes slidably received within the slots of the rotor. The vane pump assembly also includes a second bearing member which is disposed within the proximate portion of the housing adjacent the cam ring and which also has a plurality of outlet orifices in fluid flow communication with the fluid outlet port. An end plate is also mounted within the distal portion of the pump housing.

Rotation of the rotor by the drive shaft causes fluids from the fluid inlet port to be drawn through the plurality of inlet orifices at an initial fluid pressure. The fluids are then directed along a plurality of fluid flow paths disposed between an inner surface of the cam ring and an outer surface of the rotor and then ejected through the plurality of outlet orifices to the fluid outlet port at a second fluid pressure which is greater than the initial fluid pressure.

In certain embodiments according to the present disclosure, the vane pump assembly preferably also includes a relief valve assembly for providing fluid flow from the outlet port to the inlet port when the pressure difference between the outlet port and the inlet port exceeds a predetermined amount. This relief valve assembly includes a passage for selectively providing flow communication between the outlet port and the inlet port. The relief valve assembly also includes a relief valve member positioned at least partially within the passage and movable between a closed position preventing flow communication between the outlet port and the inlet port and an open position allowing flow communication between the outlet port and the inlet port. A spring is also included for biasing the relief valve member in the closed position until the pressure difference between the outlet port and the inlet port exceeds the predetermined amount. More preferably, the relief valve assembly also includes an adjustment screw for partially compressing the spring and thereby varying the bias on the relief valve member.

In certain other embodiments according to the present disclosure, the second bearing member preferably includes an opening through which the pump drive shaft may extend.

In still other embodiments according to the present disclosure, the vane pump assembly preferably also includes a compressible seal for sealing the opening in the second bearing member. This compressible seal is biased between the second bearing member and the proximate end of the pump housing.

In certain embodiments according to the present disclosure, the first bearing member preferably has two inlet orifices and the second bearing member preferably has two outlet orifices.

In some embodiments according to the present disclosure, the rotor preferably has at least 8 radial slots formed therein and at least 8 vanes are slidably received within the slots of the rotor In some embodiments according to the present disclosure, the pump housing is preferably formed from metal and the end plate is preferably formed from plastic.

In certain embodiments according to the present disclosure, the vane pump assembly preferably also includes an O-ring and retaining ring adjacent the end plate for providing a fluid seal in the distal portion of the pump housing.

In certain embodiments according to the present disclosure, radial and thrust loads exerted by fluids being directed along each of the plurality of the fluid flow paths are substantially balanced by radial and thrust loads exerted by fluids moving along the remaining fluid flow paths.

Advantageously, the components may be manufactured to somewhat less stringent physical tolerances than if the components were subjected to unbalanced radial and thrust loads. Thus, more components can be manufactured from materials such as plastics. In addition, the need for precision machining of pump components is reduced in comparison to prior art sliding vane pump designs having only a single fluid flow path within the pump. For instance, the pump housing according to the present disclosure may be manufactured to somewhat looser tolerances than previously required in prior art pump designs.

In still another aspect, the present disclosure provides a vane pump assembly for a fluid pump. In one embodiment, the pump assembly includes a pump housing having a fluid inlet port and a fluid outlet port. A rotor is also included which is adapted to be mounted to a pump drive shaft and disposed within an opening in the pump housing. The rotor also includes a plurality of radial slots formed therein; and a plurality of vanes are slidably received within the slots of the rotor. Rotation of the rotor by the drive shaft causes fluids to be drawn through the fluid inlet port at an initial fluid pressure, to be directed along a plurality of fluid flow paths disposed between the pump housing and an outer surface of the rotor and to be ejected through the fluid outlet port at a second fluid pressure which is greater than the initial fluid pressure. In addition, radial loads exerted by fluids being directed along each of the plurality of the fluid flow paths are substantially balanced by radial loads exerted by fluids moving along the remaining fluid flow paths.

In certain embodiments according to the the present disclosure, the vane pump assembly also preferably includes a first bearing member which is disposed within the pump housing. The first bearing member has a plurality of inlet orifices in fluid flow communication with the fluid inlet port. The vane pump assembly also preferably includes a cam ring which is disposed within the housing adjacent the first bearing member and between the pump housing and the outer surface of the rotor. The vane pump assembly also preferably includes a second bearing member disposed within the pump housing adjacent the cam ring. This second bearing member includes a plurality of outlet orifices in fluid flow communication with the fluid outlet port.

More preferably, the first bearing member has two inlet orifices and the second bearing member has two outlet orifices.

In certain embodiments according to the present disclosure it is also preferred that the pump housing be made from a polymeric material and be formed by a molding process and without any secondary machining of the housing.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

According to one embodiment of the present disclosure, a fluid pump 10 is provided. The fluid pump 10 according to the present disclosure is suitable for pumping a wide variety of liquids. The fluid pump 10 is particularly suited for pumping water for use in beverages, such as for pumping water in carbonated water systems, for espresso machines, and beer cooling systems.

Figure 1:
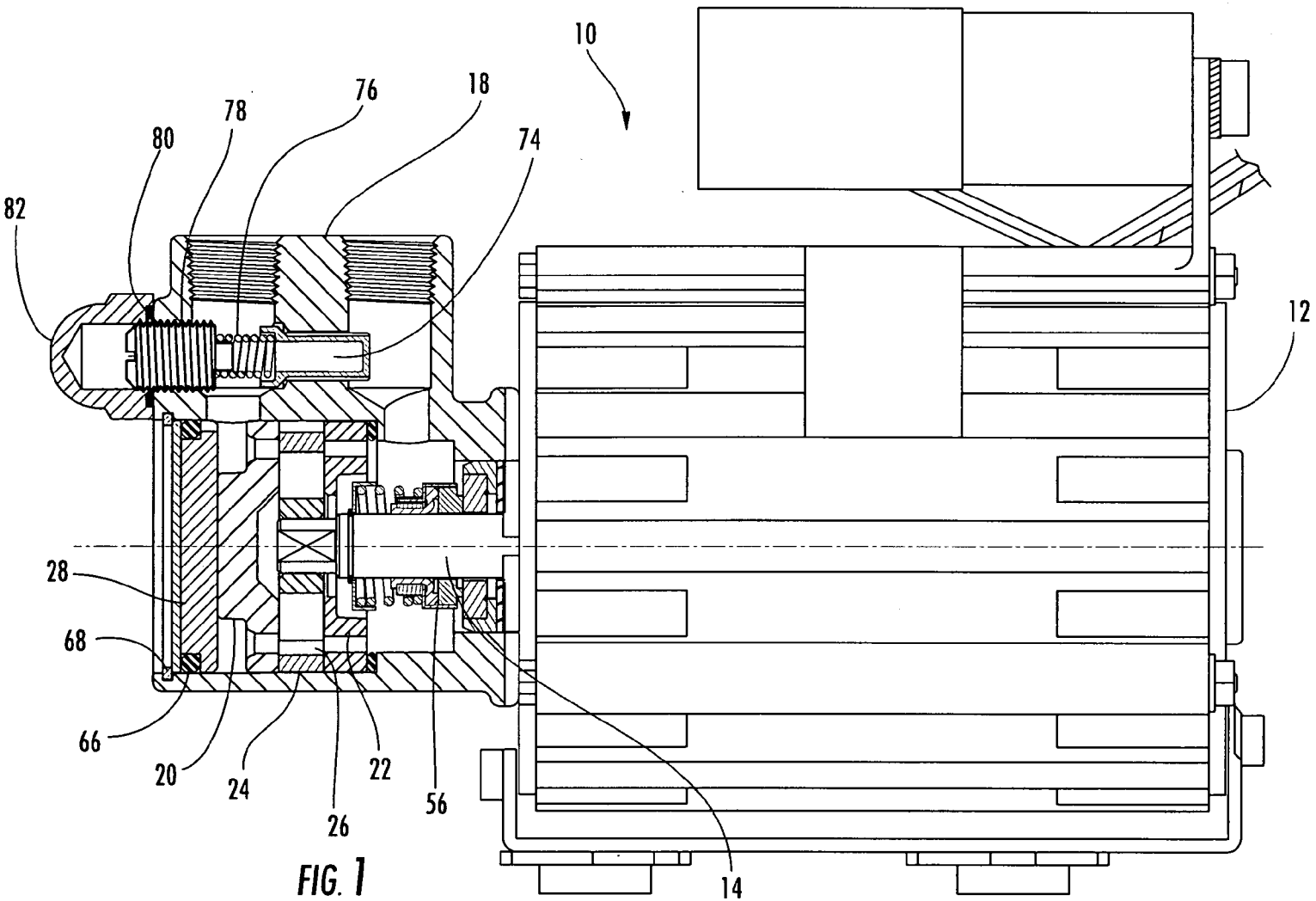
FIG. 1 is a side view of a fluid pump according to one embodiment of the present disclosure illustrating a vane pump assembly in cross-section.

As may be seen in FIG. 1, the fluid pump 10 includes a pump motor 12. The pump motor 12 is preferably an electric motor: however, the pump motor 12 may alternatively be powered by other means such as by internal combustion. A pump drive shaft 14 is attached to the pump motor 12 and driven thereby. The pump drive shaft 14 is preferably made from a metal such as steel.

Figure 2:
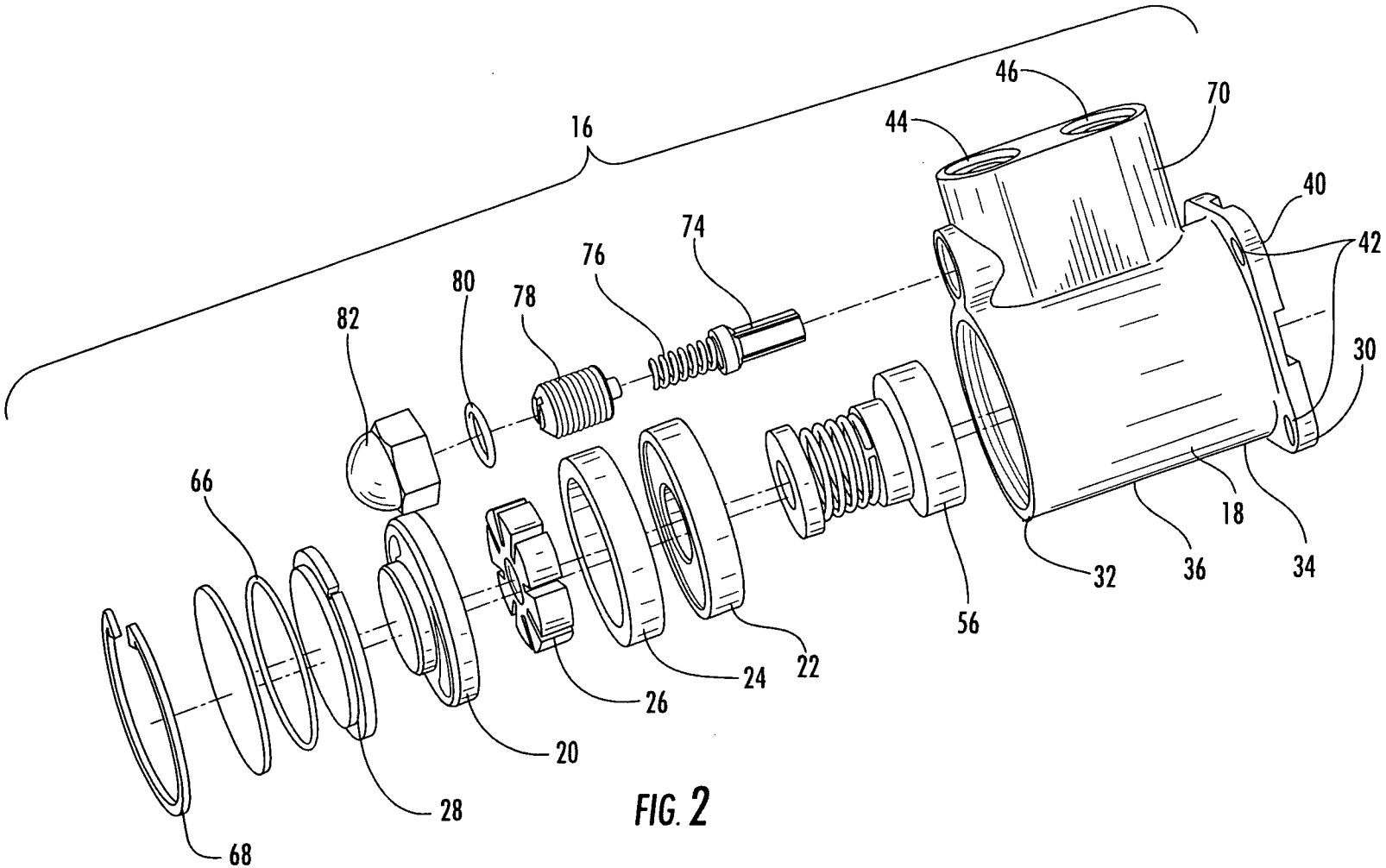
FIG. 2 is an exploded view of a vane pump assembly according to one embodiment of the present disclosure.

The fluid pump 10 also includes a vane pump assembly 16 which is attached to the pump motor 12 and driven by the drive shaft 14. With further reference to FIG. 2, the vane pump assembly 16 includes at least a pump housing 18, a first bearing member 20, a second bearing member 22, a cam ring 24, a rotor 26, and an end plate 28.

The pump housing 18 is preferably generally cylindrical in shape. For convenience, the end of the pump housing 18 adjacent the pump motor 12 is referred to herein as the proximate end 30, and the end of the pump housing 18 opposite the pump motor 12 is referred to herein as the distal end 32. Likewise the portion of the pump housing 18 adjacent the pump motor 12 is referred to herein as the proximate portion 34, and the portion of the pump housing 18 opposite the pump motor 12 is referred to herein as the distal portion 36. The cam ring 24 may be taken as providing an imaginary dividing line between the distal and proximate portions 34, 36 of the pump housing 18.

The proximate end 30 of the pump housing 18 is adapted to be mounted on the pump motor 12, preferably by means of a flange 40 having a plurality of bolt holes 42 formed therein. The pump housing 18 also includes both a fluid inlet port 44 and a fluid outlet port 46. The fluid inlet port 44 is formed in the distal portion 36 of the housing 18 and the fluid outlet port 46 is formed in a proximate portion 34 of the housing 18.

The pump housing 18 is generally formed from a high strength material. In certain embodiments, the pump housing 18 is preferably formed from a metal such as brass or stainless steel; however, in other embodiments, the pump housing 18 is preferably made from a high strength plastic material. More preferably the pump housing 18 is made from an injection molded plastic material. The plastic material may be reinforced with fibers such as glass fibers for added strength. In certain embodiments according to the present disclosure, no additional or secondary machining operations (milling, grinding, CNC, etc.) are carried out on the plastic housing after it is molded to shape.

The first and second bearing members 20, 22 and the cam ring 24 are fitted inside the pump housing 18, with the first bearing member 20 being disposed in the distal portion 36 of the housing 18 and adjacent the cam ring, the second bearing member 22 being disposed in the proximate portion 34 of the housing 18 and adjacent the cam ring 24, and the cam ring 24 being disposed between the bearing members.

The bearing members and cam ring 24 may be formed from a metal; however, the bearing members and cam ring 24 may also be suitably formed from a rigid non-metallic material, such as plastic or a composite material. In some embodiments according to the present disclosure, the bearing members 20, 22 and the cam ring 24 are preferably formed from a synthetic graphite composite material. A slot or groove 48 is preferably formed on the exterior surface of the cam ring 24 and the each of the bearing members. A key is preferably inserted into these slots or grooves 48 so as to maintain the cam ring 24 and bearing members 20, 22 in a desired alignment relative to one another.

Figure 4:
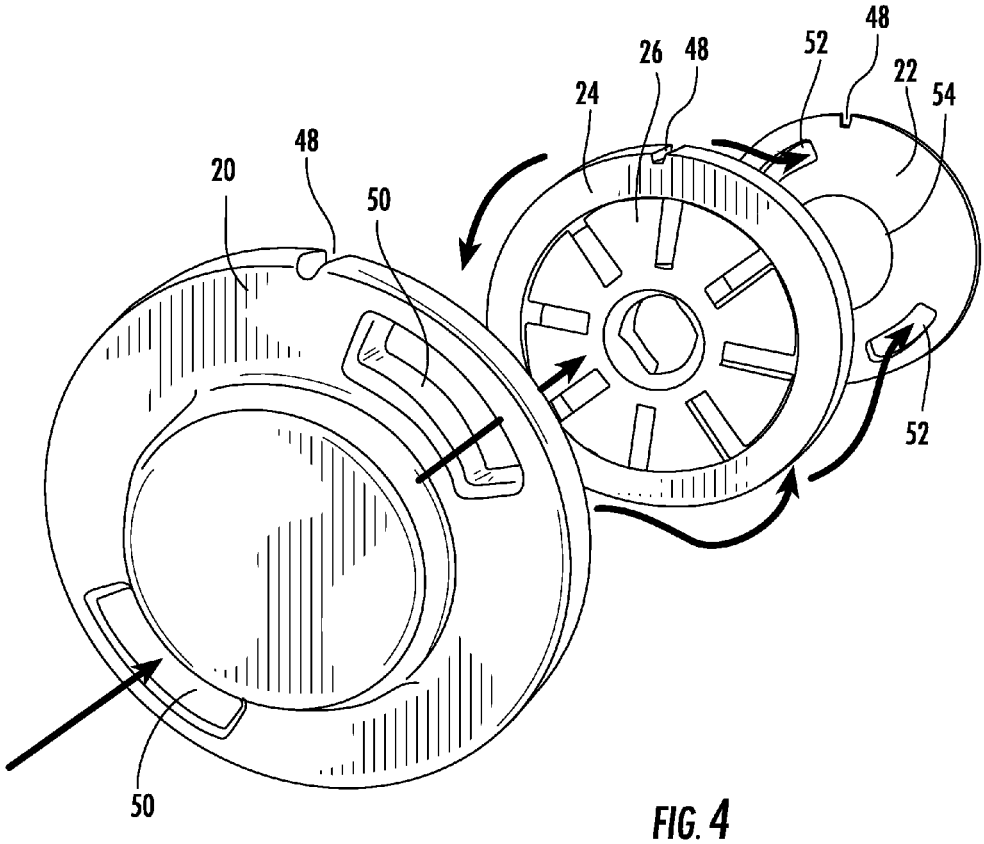
FIG. 4 is an exploded view of part of a vane pump assembly according to one embodiment of the present disclosure illustrating the fluid flow path through the vane pump assembly.

As may be seen in FIG. 4, the first bearing member 20 includes a plurality of inlet orifices 50, preferably two inlet orifices 50, which allow fluids to flow from the fluid inlet port 44 through the first bearing member 20 and into the interior of the cam ring 24 as discussed in greater detail below. Preferably, the inlet orifices 50 are shaped as curved slots formed in the first bearing member 20.

Likewise, the second bearing member 22 includes a plurality of outlet orifices 52, preferably two outlet orifices 52, which allow fluids to flow from the interior of the cam ring 24 through the second bearing member 22 and to the fluid outlet port 46. The outlet orifices 52 are also preferably shaped as curved slots. Significantly, the outlet orifices 52 are offset from the inlet orifices 50, preferably by an angle of approximately 90 degrees as measured from the centers of the respective inlet and outlet orifices.

The second bearing member 22 also preferably includes an opening 54 to allow the pump drive shaft 14 to pass through the second bearing member 22 into the interior of the cam ring. A compressible seal 56 is preferably also provided for sealing this opening 54 in the second bearing member 22. The compressible seal 56 is disposed between, and biased by, the second bearing member 22 and the proximate end 30 of the pump housing 18.

Figure 3:
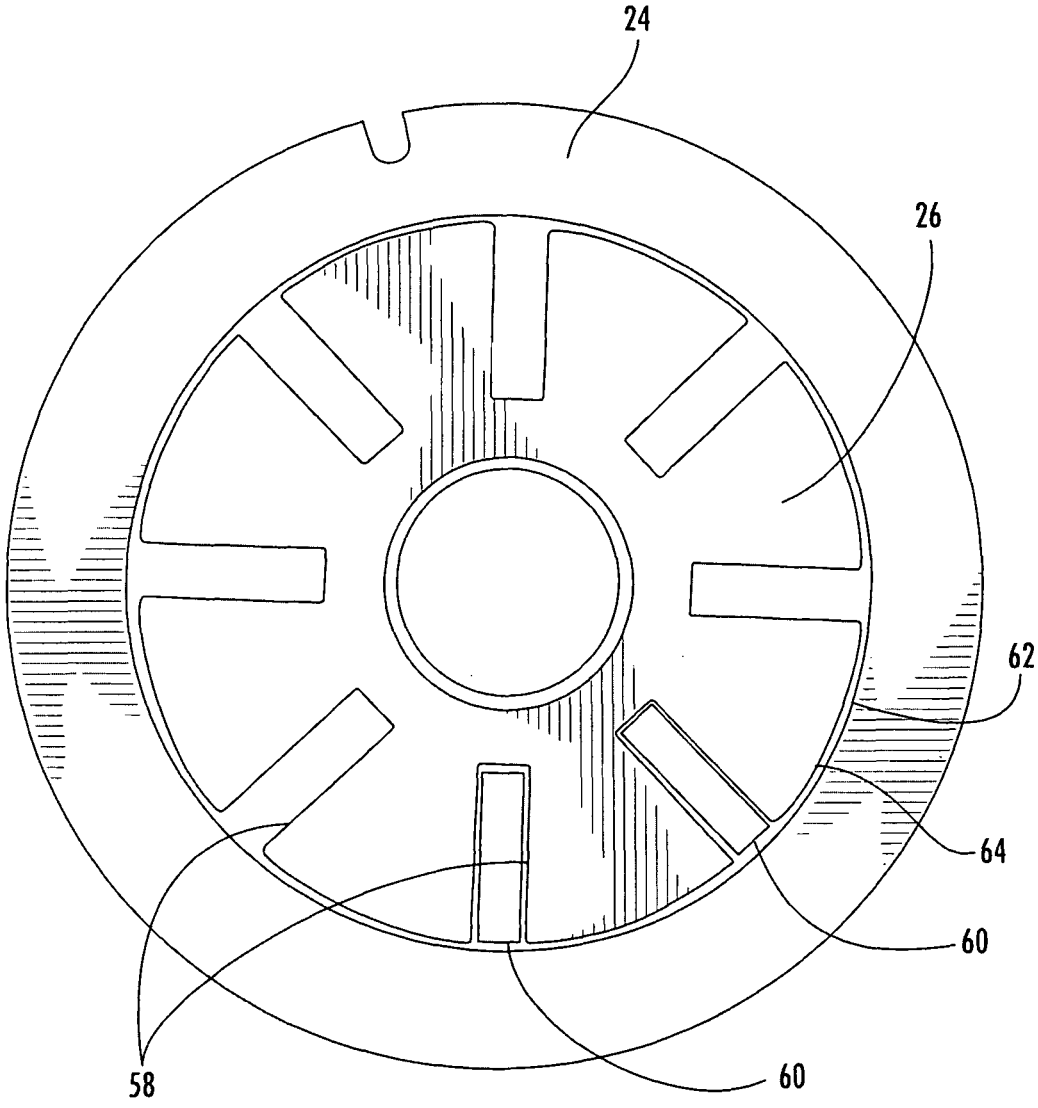
FIG. 3 is a side view of a cam ring, rotor, and vanes according to one embodiment of the present disclosure.

As illustrated in greater detail in FIG. 3, a rotor 26 is disposed within the interior of the cam ring. The rotor 26 is attached to the end of the pump drive shaft 14 and driven thereby. The rotor 26 is generally formed from a high-strength material, preferably a metal such as brass or stainless steel. A plurality of radially oriented slots 58 are formed in the rotor 26 and a plurality of vanes 60 are slidably received within the rotor slots 58. Preferably the rotor 26 includes at least 8 slots with at least 8 vanes slidably received therein. Since the vanes 60 are slidably received within the rotor slots 58, rather than being permanently attached thereto, the vanes 60 will tend to accelerate towards the cam ring 24 as the rotor 26 is rotated and protrude out of the rotor slots 58. In certain embodiments according to the present disclosure, the vanes 60 are preferably formed from a synthetic graphite composite material.

The inner surface 62 of the cam ring 24 preferably has a somewhat elliptical shape while the outer surface 64 of the rotor 26 is generally circular in shape, aside from the slots formed therein. It will be appreciated then that two gaps or cavities are formed between the inner surface 62 of the cam ring 24 and the outer surface 64 of the rotor 26 as illustrated, in exaggerated form, in FIG. 3. Alternatively, the twin cavities may be provided by forming the outer surface 64 of the rotor 26 in a somewhat elliptical shape while forming the inner surface 62 of the cam ring 24 in a generally circular shape. Moreover, since the distance between the rotor 26 and the inner surface 62 of the cam ring 24 varies, the extent to which the vanes 60 protrude out of the rotor slots 58 will also vary as the rotor 26 rotates.

An end plate 28 is also mounted within the distal portion 36 of the housing 18, preferably adjacent the first bearing member 20. Unlike the pump housing 18, the end plate 28 may advantageously be formed from a relatively low strength (and hence relatively inexpensive) material Such as plastic since, as discussed below, the end plate 28 is only subjected to the lower pressures of the inlet fluid and not the higher pressures of the outlet fluid. Preferably, an O-ring 66 and a retaining ring 68 are also inserted into the pump housing 18 adjacent the end plate 28. A second plate may also be disposed between the end plate 28 and the retaining ring 68. In conjunction with the end plate 28, the O-ring 66 and retaining ring 68 provide a fluid seal in the distal portion 36 of the pump housing 18.

Preferably, a relief valve assembly 70 is also included with the vane pump assembly 16. When the fluid pressure in the outlet port 46 exceeds the fluid pressure in the inlet port 44 by a predetermined amount, the relief valve assembly 70 opens to allow fluid flow from the outlet port 46 to the inlet port 44, thereby reducing the outlet port 46 fluid pressure.

As may be seen in FIGS. 1 and 2, this relief valve assembly 70, in one embodiment includes a passage 72 for selectively providing flow communication between the outlet port 46 and the inlet port 44. A relief valve member 74 is positioned at least partially within this passage 72 and is movable between a closed position and an open position. In the closed position, the relief valve member 74 prevents flow communication between the outlet port 46 and the inlet port 44 while in the open position the relief valve member 74 allows How communication between the outlet port 46 and the inlet port 44. A spring 76 is also included which abuts against the relief valve member 74 and biases the relief valve member 74 in the closed position under normal conditions. When the pressure difference between the outlet port 46 and the inlet port 44 exceeds the predetermined amount, however, the force on the relief valve member 74 due to the pressure differential overcomes the spring force and moves the relief valve member 74 to the open position thereby allowing fluid flow through the passage 72 and relieving the excess pressure in the outlet port 46. In certain embodiments of the present disclosure, the relief valve assembly 70 also preferably includes an adjustment screw 78 for partially compressing the spring 76 and thereby varying the bias on the relief valve member 74. An O-ring 80 and an acorn nut 82 may also be fitted over the adjustment screw 78 to provide an effective fluid seal.

Figure 5:
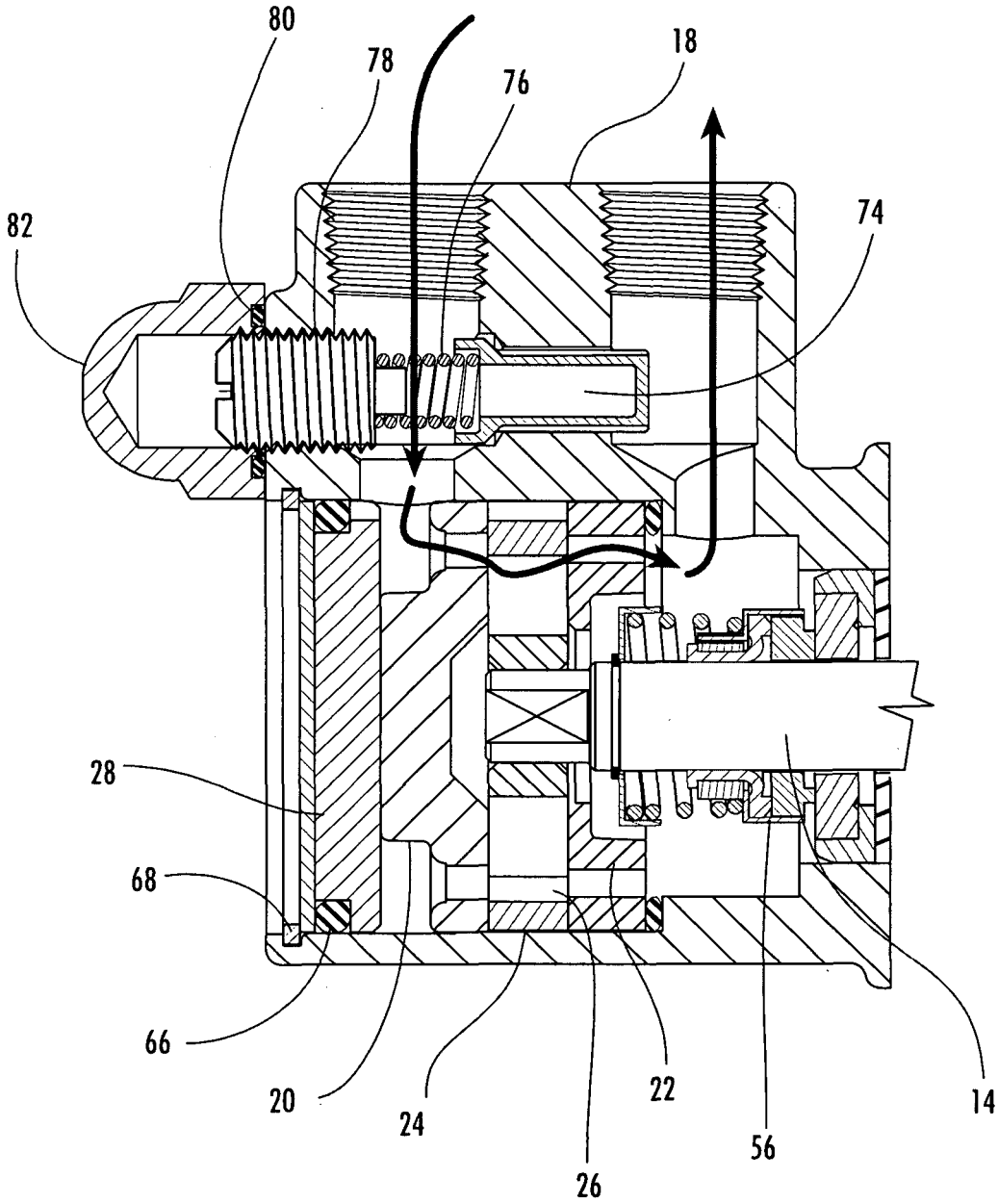
FIG. 5 is a cross-sectional view of a vane pump assembly according to one embodiment of the present disclosure illustrating the fluid flow path through the vane pump assembly.

In operation, the pump motor 12 turns the pump drive shaft 14 thereby turning the rotor 26 as well. As illustrated in FIGS. 4 and 5, rotation of the rotor causes fluids from the fluid inlet port 44 to be drawn through the plurality of inlet orifices 50 at an initial fluid pressure. The fluids are then directed along a plurality of arcuate fluid flow paths between the inlet orifices 50 and the outlet orifices 52. The fluid flow paths correspond to the space between the inner surface 62 of the cam ring 24 and the outer surface 62 of the rotor 26. Finally, the fluids are ejected through the plurality of outlet orifices 52 to the fluid outlet port 46 at a second fluid pressure which is greater than the initial fluid pressure.

A significant advantage is accorded by the movement of the fluid along the plurality of fluid flow paths according to the present disclosure. Movement of the fluids along each of the individual fluid flow paths places significant radial and thrust loads upon the components of the vane pump assembly 16, including the pump housing 18, the first and second bearing members 20, 22, the cam ring 24, and the rotor 26. According to the present disclosure, however, the radial loads exerted by fluids moving along the individual fluid flow paths are substantially balanced, and thus cancelled out, by the radial loads exerted by fluids moving along the remaining fluid flow paths. In some instances a portion of the thrust loads may be cancelled out as well.

Advantageously, because the loads being exerted upon the components of the vane pump assembly 16 are substantially balanced in this manner, the components may be manufactured to somewhat less stringent physical tolerances than if the components were subjected to unbalanced radial and thrust loads. In particular, the pump housing 18 may be manufactured to less stringent physical tolerances. This in turn preferably allows for the pump housing 18 to be fabricated from a relatively inexpensive plastic material, more preferably a molded plastic material, rather than being machined from a more expensive metal material. Further, once molded to shape, no additional machining operations, such as milling or grinding, are needed to bring the pump housing into its final tolerances. In addition, more components can be manufactured from materials such as plastics and the need for precision machining of pump components is reduced.

This is in contrast to prior art sliding vane pump designs having only a single fluid flow path within the pump. Movement of the fluids along a single fluid flow path in such pumps places significant radial loads, as well as thrust loads, upon the components of the vane pump assembly which are not balanced. In order to properly function in spite of these loads, components in these prior art designs must typically be precisely machined from metals or other expensive materials which can be machined to very high tolerances. Molded plastic components generally cannot be used in such pump designs.

As previously noted, fluid pumps according to the present disclosure are suitable for pumping a wide variety of liquids, but are particularly suited to food and beverage service application such as for pumping water in carbonated water systems, for espresso machines, and beer cooling systems. In these applications it is particularly advantageous to use a molded plastic pump, which is fiber reinforced for added strength, but which has not been subjected to secondary machining operations subsequent to being molded. Subsequent machining of the surfaces of the molded plastic would expose the reinforcing fiber material and lead to contact between the fibers and the water or other fluids being pumped. In a food and beverage application, contact between such fibers and the water/beverage may be undesirable or may be forbidden by applicable health and safety regulations. Advantageously, such concerns are eliminated if the plastic pump housing is molded to shape without the need for further machining steps.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A vane pump assembly for a fluid pump, said pump assembly comprising:

a pump housing having a proximate portion and a distal portion, wherein the proximate portion of the housing is adapted to be mounted to a pump motor;

a fluid inlet port formed in a distal portion of the housing;

a fluid outlet port formed in a proximate portion of the housing;

a first bearing member disposed within the distal portion of the housing, the first bearing member having a plurality of inlet orifices in fluid flow communication with the fluid inlet port;

a cam ring disposed within the housing adjacent the first bearing member;

a rotor adapted to be mounted to a pump drive shaft and disposed within an opening in the cam ring, the rotor having a plurality of radial slots formed therein;

a plurality of vanes slidably received within the slots of the rotor;

a second bearing member disposed within the proximate portion of the housing adjacent the cam ring, the second bearing member having a plurality of outlet orifices in fluid flow communication with the fluid outlet port; and an end plate mounted within the distal portion of the housing wherein rotation of the rotor by the drive shaft causes fluids from the fluid inlet port to be drawn through the plurality of inlet orifices at an initial fluid pressure, to be directed along a plurality of fluid flow paths disposed between an inner surface of the cam ring and an outer surface of the rotor, and to be ejected through the plurality of outlet orifices to the fluid outlet port at a second fluid pressure which is greater than the initial fluid pressure and wherein the pump housing comprises a molded polymeric material with unmachined molded surfaces.

2. The vane pump assembly of claim 1, further comprising a relief valve assembly for providing fluid flow from the outlet port to the inlet port when the pressure difference between the outlet port and the inlet port exceeds a predetermined amount, the relief valve assembly including a passage for selectively providing flow communication between the outlet port and the inlet port;

a relief valve member positioned at least partially within the passage and movable between a closed position preventing flow communication between the outlet port and the inlet port and an open position allowing flow communication between the outlet port and the inlet port;

a spring for biasing the relief valve member in the closed position until the pressure difference between the outlet port and the inlet port exceeds the predetermined amount.

3. The vane pump assembly of claim 2, further comprising an adjustment screw for partially compressing the spring and thereby varying the bias on the relief valve member.

4. The vane pump assembly of claim 1, wherein the second bearing member includes an opening through which the pump drive shaft may extend.

5. The vane pump assembly of claim 4, further comprising a compressible seal for sealing the opening in the second bearing member, wherein the compressible seal is biased between the second bearing member and the proximate end of the pump housing.

6. The vane pump assembly of claim 1, wherein the first bearing member has two inlet orifices and the second bearing member has two outlet orifices.

7. The vane pump assembly of claim 1, wherein the rotor has at least 8 radial slots formed therein and at least 8 vanes are slidably received within the slots of the rotor.

8. The vane pump assembly of claim 1, wherein the pump housing is formed from metal and the end plate is formed from plastic.

9. The vane pump assembly of claim 1, further comprising an O-ring and retaining ring adjacent the end plate for providing a fluid seal in the distal portion of the pump housing.

10. The vane pump assembly of claim 1, wherein radial and thrust loads exerted by fluids being directed along each of the plurality of the fluid flow paths are substantially balanced by radial and thrust loads exerted by fluids moving along the remaining fluid flow paths.

11. A fluid pump comprising:

a pump motor;

a pump drive shaft attached to the pump motor; and a vane pump assembly including a pump housing having a proximate portion and a distal portion, wherein the proximate portion of the housing is mounted to the pump motor so that the pump drive shaft extends through the proximate portion of the pump housing;

a fluid inlet port formed in a distal portion of the housing;

a fluid outlet port formed in a proximate portion of the housing;

a first bearing member disposed within the distal portion of the housing, the first bearing member having a plurality of inlet orifices in fluid flow communication with the fluid inlet port;

a cam ring disposed within the housing adjacent the first bearing member;

a rotor mounted on the pump drive shaft and disposed within an opening in the cam ring, the rotor having a plurality of radial slots formed therein;

a plurality of vanes slidably received within the slots of the rotor;

a second bearing member disposed within the proximate portion of the housing adjacent the cam ring, the second bearing member having a plurality of outlet orifices in fluid flow communication with the fluid outlet port; and an end plate mounted within the distal portion of the housing wherein rotation of the rotor by the pump drive shaft causes fluids from the fluid inlet port to be drawn through the plurality of inlet orifices at an initial fluid pressure, to be directed along a plurality of fluid flow paths disposed between an inner surface of the cam ring and an outer surface of the rotor, and to be ejected through the plurality of outlet orifices to the fluid outlet port at a second fluid pressure which is greater than the initial fluid pressure and wherein the pump housing comprises a molded polymeric material with unmachined molded surfaces.

12. The fluid pump of claim 11, wherein the vane pump assembly further includes a relief valve assembly for providing fluid flow from the outlet port to the inlet port when the pressure difference between the outlet port and the inlet port exceeds a predetermined amount, the relief valve assembly including a passage for selectively providing flow communication between the outlet port and the inlet port;

a relief valve member positioned at least partially within the passage and movable between a closed position preventing flow communication between the outlet port and the inlet port and an open position allowing flow communication between the outlet port and the inlet port;

a spring for biasing the relief valve member in the closed position until the pressure difference between the outlet port and the inlet port exceeds the predetermined amount.

13. The fluid pump of claim 12, wherein the vane pump assembly further includes an adjustment screw for partially compressing the spring and thereby varying the bias on the relief valve member.

14. The fluid pump of claim 11, wherein the pump drive shaft extends through an opening in the second bearing member.

15. The fluid pump of claim 14, wherein the vane pump assembly further includes a compressible seal for sealing the opening in the second bearing member, wherein the compressible seal is biased between the second bearing member and the proximate end of the pump housing.

16. The fluid pump of claim 11, wherein the first bearing member has two inlet orifices and the second bearing member has two outlet orifices.

17. The fluid pump of claim 11, wherein the rotor has at least 8 radial slots formed therein and at least 8 vanes are slidably received within the slots of the rotor.

18. The fluid pump of claim 11, wherein the pump housing is formed from metal and the end plate is formed from plastic.

19. The fluid pump of claim 11, wherein the vane pump assembly further includes an O-ring and retaining ring adjacent the end plate for providing a fluid seal in the distal portion of the pump housing.

20. The fluid pump of claim 11, wherein, radial and thrust loads exerted by fluids being directed along each of the plurality of the fluid flow paths are substantially balanced by radial and thrust loads exerted by fluids moving along the remaining fluid flow paths.

21. A vane pump assembly for a fluid pump, said pump assembly comprising:

a pump housing having a fluid inlet port and a fluid outlet port;

a rotor adapted to be mounted to a pump drive shaft and disposed within an opening in the pump housing, the rotor having a plurality of radial slots formed therein; and a plurality of vanes slidably received within the slots of the rotor;

wherein rotation of the rotor by the drive shaft causes fluids to be drawn through the fluid inlet port at an initial fluid pressure, to be directed along a plurality of fluid flow paths disposed between the pump housing and an outer surface of the rotor, and to be ejected through the fluid outlet port at a second fluid pressure which is greater than the initial fluid pressure and wherein radial loads exerted by fluids being directed along each of the plurality of the fluid flow paths are substantially balanced by radial loads exerted by fluids moving along the remaining fluid flow paths and wherein the pump housing comprises a molded polymeric material with unmachined molded surfaces.

22. The vane pump assembly of claim 21, further comprising a first bearing member disposed within the pump housing, the first bearing member having a plurality of inlet orifices in fluid flow communication with the fluid inlet port;

a cam ring disposed within the housing adjacent the first bearing member and between the pump housing and the outer surface of the rotor; and a second bearing member disposed within the pump housing adjacent the cam ring, the second bearing member having a plurality of outlet orifices in fluid flow communication with the fluid outlet port.

23. The vane pump assembly of claim 22, wherein the first bearing member has two inlet orifices and the second bearing member has two outlet orifices.

* * * * *

UNITED STATES PATENT AND TRADEMARK OFFICE

CERTIFICATE OF CORRECTION

PATENT NO. : 8,419,384 B2
APPLICATION NO. : 12/250753
DATED : April 16, 2013
INVENTOR(S) : Jiang et al.

It is certified that error appears in the above-identified patent and that said Letters Patent is hereby corrected as shown below:

On the Title page of the patent under:
(75) Inventors:
Please delete "Jang" and insert -- Jiang --.

Signed and Sealed this
Twenty-first Day of May, 2013

Teresa Stanek Rea
*Acting Director of the United States Patent and Trademark Office*